United States Patent [19]

Brucken et al.

[11] 4,108,577

[45] Aug. 22, 1978

[54] VARIABLE DISPLACEMENT COMPRESSOR

[75] Inventors: Byron L. Brucken, Miamisburg; Dennis A. Black, Dayton, both of Ohio

[73] Assignee: General Motors Corporation, Detroit, Mich.

[21] Appl. No.: 804,932

[22] Filed: Jun. 9, 1977

[51] Int. Cl.[2] ..... F04B 1/12; F16H 23/00

[52] U.S. Cl. ..... 417/222; 74/60; 417/270

[58] Field of Search ..... 417/222, 269, 270; 74/60; 92/12.2

[56] References Cited

U.S. PATENT DOCUMENTS

| | | | |
|---|---|---|---|
| 2,711,135 | 6/1955 | Dunlap | 417/222 |
| 2,934,234 | 12/1960 | Looms | 74/60 |
| 2,955,475 | 10/1960 | Zubaty | 417/222 |
| 3,062,020 | 11/1962 | Heidorn | 62/196 |

*Primary Examiner*—William L. Freeh

*Attorney, Agent, or Firm*—Edward P. Barthel

[57] ABSTRACT

A wobble plate compressor in which the output of the compressor is modulated in response to refrigeration requirements by varying the compressor piston displacement to match the cooling requirement. The compressor housing front end has an axial protruding integral tubular extension which supports one end of a drive shaft by means of a journal bearing supported in the tubular extension. A cup-shaped hydraulic modulating cylinder is located in an axial fixed relation on the drive shaft adjacent the front end cover such that a disc-shaped piston, mounted on an axially slidable sleeve surrounding the drive shaft, is telescopically received in the cylinder rearwardly facing open end so as to define with the cylinder an expansible hydraulic chamber. An axially extending recess in the shaft defines an open-ended passage providing hydraulic fluid flow communication between radial passage means in the housing front end and the expansible chamber.

2 Claims, 5 Drawing Figures

VARIABLE DISPLACEMENT COMPRESSOR

This invention relates to a variable displacement wobble plate refrigerant compressor and more particularly to an automotive air conditioning variable displacement compressor having an improved expansible chamber.

In the co-pending U.S. Patent application Ser. No. 747,043, filed Dec. 2, 1976, Now U.S. Pat. No. 4,061,443 to Dennis A. Black and Byron L. Brucken assigned to the same assignee as the present application, a variable displacement automotive air conditioning wobble plate compressor is described. In the present invention an improved hydraulic fluid control chamber and lubricant flow arrangement therefor is provided which achieves an overall reduction in size together with the simplification of various manufacturing and assembly operations.

It is an object of the present invention to provide an improved automobile air conditioning wobble plate compressor wherein a cup-shaped hydraulic chamber is located in axial fixed relation on the drive shaft adjacent the front end cover, such that an axially movable disc-shaped piston is adapted to be telescopically received in the cylinder rearwardly facing open end defining with the cylinder an expansible hydraulic modulating chamber in a manner to provide a compact assembly by reducing the overall length of the compressor housing.

It is another object of the present invention to provide an improved hydraulic control oil flow arrangement for a modulating variable displacement wobble plate compressor expansible chamber defined by a cup-shaped cylinder and an axially movable disc-shaped piston. A radial lubricant passageway in the compressor front end communicates with the chamber by means of an axially extending recess in the drive shaft such that the open-ended recess extends axially on the shaft from the radial passage outlet to a location beyond the closed end of the cylinder.

Further objects and advantages of the present invention will be apparent from the following description, reference being had to the accompanying drawings wherein a preferred embodiment of the present invention is clearly shown.

Figure 1:
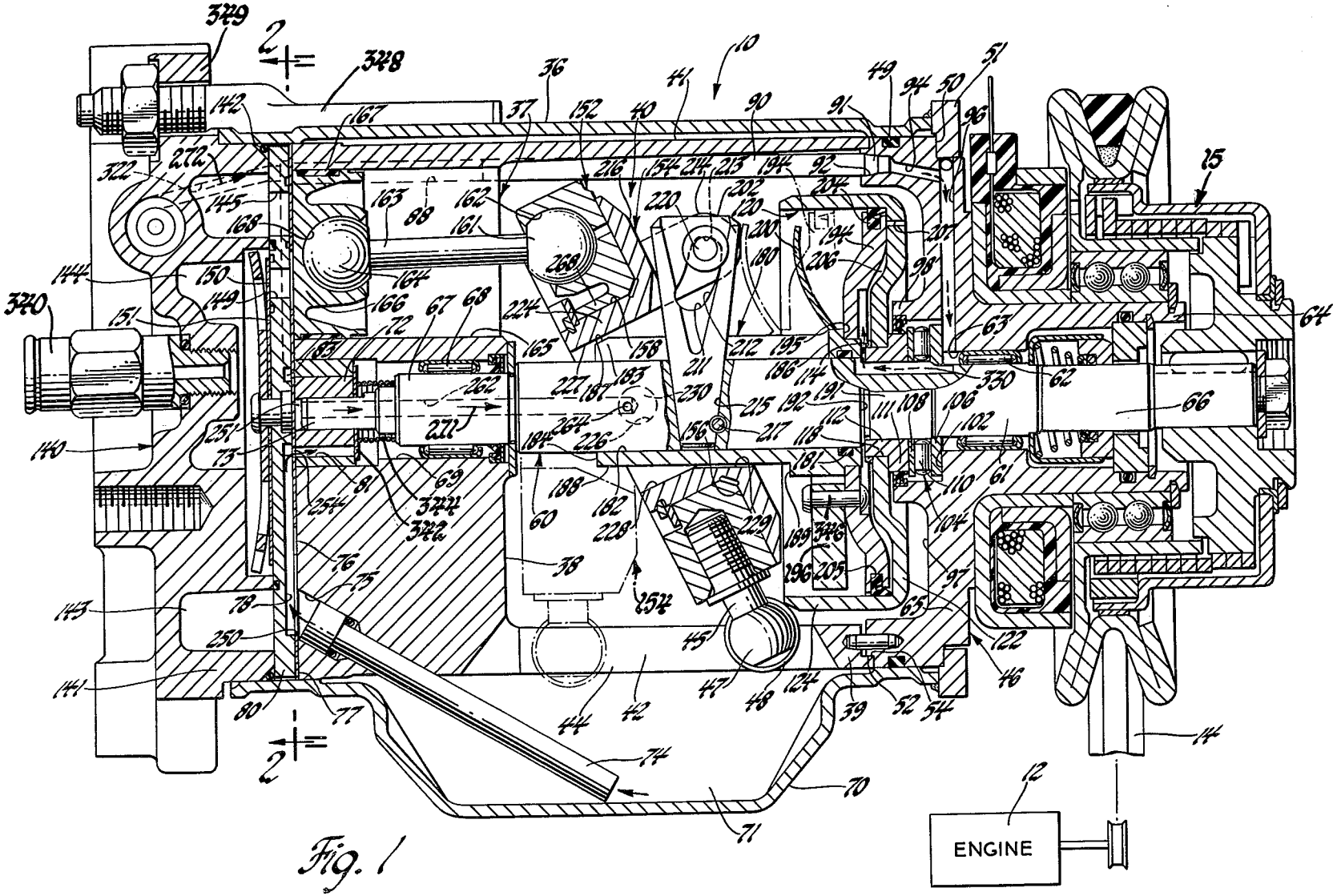
FIG. 1 is a vertical sectional view showing the compressor of the present invention.

Referring now to the drawings, wherein a preferred embodiment of the invention is shown, numeral 10 in FIG. 1 designates a variable displacement axial compressor which is adapted to be driven by main car engine 12 through suitable belt means 14 in a manner shown and described in the mentioned patent application. The prior art, as shown and described in U.S. Pat. No. 3,062,020 to J. H. Heidorn and assigned to the assignee of the present application, shows a compressor driven from the car motor by a belt such that it operates at widely varying speeds which are determined by the vehicle speed rather than by refrigeration requirements. On current auto air conditioning systems compressor capacity control is obtained by use of an electromagnetic clutch 15 disclosed in U.S. Pat. No. 3,876,048 to Brier. In the clutch starting and stopping system, described in the mentioned patent application Ser. No. 747,043, the compressor's principle of operation involves reducing the refrigerant pressure drop between the evaporator and the compressor by varying the compressor displacement to match the cooling requirement of the car. As a result, at moderate temperatures the compressor capacity is modulated to pump only the amount of refrigerant required to cool the car. Suction gas is delivered from the evaporator to the compressor at higher pressures and densities because, with the elimination of the suction throttling valve there is a reduction of line pressure drop. The fact that suction gas enters the compressor at a higher density together with the reduction of mechanical or friction losses achieves a reduction in its power requirements.

Figure 5:
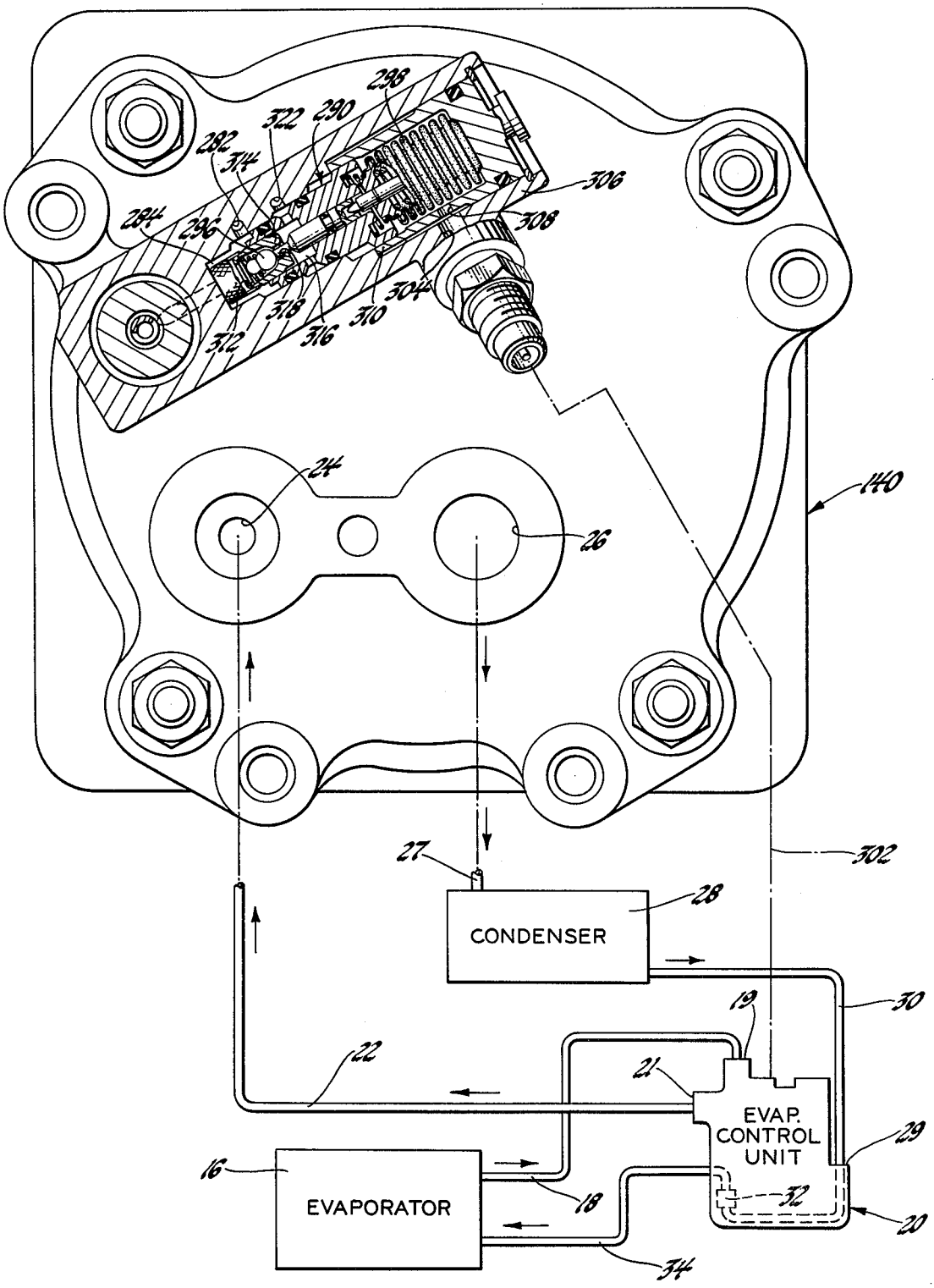
FIG. 5 is an end elevational view with parts broken away of the compressor and a cooling system schematic.

As shown schematically in FIG. 5, the refrigerating system includes the usual refrigerant evaporator 16 having an outlet line 18 leading to the one inlet 19 of a receiver 20 and exits at 21 into line 22 leading to the compressor inlet 24. The compressed refrigerant leaves the compressor 10 through an outlet 26 into line 27 connected to a conventional condenser 28. The condensed refrigerant returns to a second inlet 29 of the receiver 20 by line 30 from whence the liquid refrigerant flows through a suitable pressure reducing means, which for the purposes of illustration has been shown as an expansion valve 32 in the receiver, and thereafter returns to the evaporator by line 34. The compressor 10 and the condenser 28 are preferably located in the engine compartment of the car while the evaporator 16 is arranged in an enclosure so as to cool air for the passenger compartment of the car in the usual manner.

The improved compressor of the present invention preferably includes an outer housing shell 36, which is substantially cylindrical in shape formed from sheet metal or as a casting. The sheel 36 encircles an inner cylinder case, generally indicated at 37, preferably cast in one piece from aluminum. The case 37 comprises a rear cylinder block 38 and a front cylinder collar 39 with wobble plate mechanism 40 therebetween and interconnected by a pair of longitudinally extending stringers one of which is indicated at 41, and a guide stringer 42. A longitudinal slot 44 is formed in the guide stringer for the reception of a guide pin or rod 45 rotatably supporting a ball 47 in suitable contoured guide shoes 48 as more fully disclosed in the mentioned patent application Ser. No. 747,043.

A front head 46, preferably formed as a separate member such as, for example, an aluminum casting, is partially telescoped in the right or front end of the housing shell 36 and sealed thereto by O-ring seal 49. An outer peripheral notch 50 is formed in the front head 46 for flush engagement of a ring 51, which ring is suitably secured as by welding to circumscribe the front end of the housing shell 36. The front head 46 has an inner annular recess 52 which telscopically underfits a complementary recess 54 of the collar 39 in nested fashion so as to align the bearing bores for reception of the compressor main drive shaft 60.

The compressor main drive shaft 60 has its forward bearing portion end 61 rotatably mounted or journaled on front needle bearings 62 in axial bore 63 formed in a protruding integral tubular extension 64 located on the front head end cover portion 65 outer surface. The extension 64 is coaxial with and surrounds the shaft intermediate end 66 in concentric fashion. The shaft 60 has its rearward reduced end 67, journaled on rearward needle bearing 68 in rear axial bore 69 of the cylinder block 37.

Figure 3:
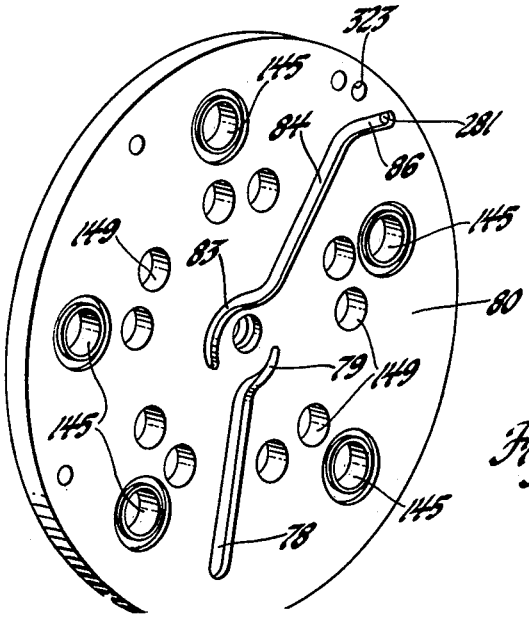
FIG. 3 is a perspective view showing the inner face of the valve plate.

The housing shell 36 completely encloses the compressor wobble plate mechanism 40 and is provided with a distended bulge portion 70 forming an oil sump or crankcase region 71 which collects, by gravity flow, oil and refrigerant mixture therein received from piston blow-by for circulation through the compressor by suitable oil flow passages providing a lubricating network for its associated bearings and seals. Lubricating oil gear pump means in the form of an oil gear pump assembly 72, driven by a D-shaped quill 73, shown in FIG. 4 as a reduced extension of the shaft rearward end 67, serves to withdraw oil and refrigerant solution from the sump 71 through an oil pickup tube or conduit 74. The tube 74, with its open upper end inserted in angled counterbore 75 of the cylinder block 38, communicates via an aperture 76 in reed valve disc 77 with an aligned vertical slotted passage 78, formed in the inner face of valve plate 80 as seen in FIG. 3. The passage 78 has an arcuate shaped upper end 79 positioned in communication with the inlet side 81 of the gear pump 72.

The gear pump outlet communicates with an arcuate portion 83 of an upper oil outlet groove 84, with the groove 84 extending radially outwardly at an acute angle from the vertical of about 30°, to an outer angled or dogleg portion 86 which terminates adjacent the periphery of the valve plate 80. The angled portion 86 of the groove terminates in a valve plate hole or orifice 281 which communicates with a rear head oil outlet bore 282 (FIG. 5) to be described. The valve plate 80 includes hole 323 aligned with a hole (not shown) in disc 77 which communicates with the inlet of crossover passage means including axial cylinder block duct 88 shown by dashed lines in FIG. 1. The forward or outlet end of the duct 88 is connected to the rearward end of an axially aligned crossover tube 90, located outboard of the wobble plate mechanism 40. The tube 90 portion of the crossover passage means has its forward or outlet end reduced at 91, as by swaging, to provide a sealed press fit within a conical aperture 92 in the front head 46.

The front head 46 provides duct means communicating with the crossover tube outlet 91 in the form of an obliquely downwardly sloped duct portion 94 communicating with the outer end of radial duct portion 96, the inner end of which is opened to the front head axial bore 63. Front head 46 inner face 97 includes a sleeve-like concentric extension 98 which, with tubular extension 64, is cast in one piece with the front head. The sleeve-like extension 98 encloses a counterbored shoulder portion 102 defining a thrust bearing surface on which is seated front thrust needle bearing assembly 104, including outer and inner thrust rings 106 and 108 respectively, having needle bearings 110 therebetween. The outer ring 108 is in flush engagement with flange 111 of cylinder bushing 112 fixedly centered as by weld 114 in axial bore 118 of a cup-shaped cylinder, generally designated 120. It will be noted that the cup-shaped cylinder 120 is oriented with its base 122 in opposed relation to the inner face 97 of the front head cover portion 65. The cylinder 120 has its cylindrical wall portion 124 extending rearwardly from its base 122 such that the open end of the cup-shaped cylinder faces the wobble plate mechanism 40.

The valve plate 80 is held against the end of the cylinder block 38 by means of the cylinder rear head assembly 140 having a cylindrical portion 141 which telescopes within the aft end of the shell 36 and is sealed thereto by compressible sealing means such as O-ring 142 sealed to the shell. The rear cylinder head assembly includes an outer suction or inlet chamber 143 and a center discharge chamber 144. As shown in FIG. 1, each compression chamber or bore 165 communicates with the suction chamber 143 through an inlet port such as the port 145 shown in FIG. 2. The inlet reed valve disc 77, having inlet reeds (not shown) controls the flow of refrigerant through the suction inlet ports 145 as shown in the Black et al patent application Ser. No. 747,043. The compressed refrigerant leaves each compression bore 165 through valve plate discharge port 149, while a reed valve 150, in discharge reed valve disc 151, located at each discharge port 149 is provided in accordance with the above referenced patent application.

For purposes of illustrating this invention, the variable displacement five cylinder axial compressor 10 will be described whereas it will be understood that the number of cylinders may be varied without departing from the spirit and scope of the invention. As seen in FIG. 1, the wobble plate drive mechanism assembly 40 includes a socket plate 152 and a journal element or wobble plate 154. The wobble plate 154 and socket plate 152 define a plane bearing surface 156 and an outer cylindrical journal surface 158 with the wobble plate rotating in unison with the shaft 60. The socket plate 152 has five sockets, one of the sockets being shown at 162, for receiving the spherical ends 161 of five connecting rods, like the connecting rods 163. The free ends of each of the connecting rod 163 are provided with spherical portions 164 as shown. Cylinder block 38 has a plurality of the axial cylinder bores 165, there being five in the preferred embodiment, in which pistons 166 are sealed by rings 167 which in the disclosed form are Teflon washers as described in U.S. Pat. No. 3,885,460, assigned to the assignee of the present application. Pistons 166, having socketlike formations 168, engage the one end of each connecting rod 163. The pistons 166 operate within their associated compression chambers or bores 165 whereby upon rotation of the drive shaft 60 and the wobble plate 154 will cause reciprocation of the pistons 166 within their bores 165.

As seen in FIG. 1, the socket plate 152 is prevented from rotating by means of the guide shoes 48 which slide within longitudinal slot 44 provided in guide stringer 42. As stated above the shoe assembly consists of the spherical ball element 47 having a socket formation which engages one end of the guide pin rod 45 the other end of which is fixedly received in a bore within the socket plate 152.

The shaft 60 has a generally cylindrical sleeve member 180 surrounding or circumscribing the shaft in hydraulic sealing relation therewith by means of compressible sealing means such as O-ring seal 181 located in a groove in the inner surface 182 of the sleeve. The sleeve member 180 has formed therein a longitudinal slot 183 extending from the sleeve inner or rearward face 184 substantially the full length of the sleeve and terminates in a U-shaped radiused portion 186 within the confines of the cup-shaped cylinder 120. The sleeve face 184 includes a chamfered front edge 187. It will be noted that the sleeve member 180 has a flat face portion 188 located in 180° opposed relation to the slot 182 and which face terminates in a notched shoulder 189 to provide clearance with the journal 154.

As seen in FIG. 1, sleeve reciprocating actuator or modulating means are provided by a hydraulic expansible chamber which includes the cup-shaped rearwardly opening axially fixed element or modulating cylinder 120, which is secured by means of its bushing 112 on the shaft portion 191 by abutting against shaft shoulder 192 for rotation therewith. The actuator means further includes an axially movable internal disc-shaped modulating piston member 194 including a counterbalance 196 secured thereto. In the disclosed embodiment the modulating piston 194 abuts sleeve shoulder 195 and is fixed on the sleeve 180 for rotation therewith by means of a return spring member 200, as seen in FIG. 1. The spring 200 is suitably retained on the sleeve as shown for example in co-pending U.S. patent application Ser. No. 747,043, now issued U.S. Pat. No. 4,061,443 assigned to the same assignee as the present application. The spring member 200 is operative upon the modulating piston 194 and sleeve 180 being moved axially to the left from its full-line position in FIG. 1 to a compressed dotted line position contacting drive lug 202 upon the wobble plate mechanism 40 being pivoted to its vertical dotted line zero stroke position relative to the shaft 60. Thus, the spring member 200 functions to bias the wobble plate mechanism 40 from its zero stroke position normal to the shaft wherein the pistons 166 start pumping or compressing refrigerant gas. It will be noted that suitable hydraulic sealing means are provided between the disc-shaped piston 194 and the inner annular surface of the cylinder 120 which in the disclosed form is a resilient seal ring 204 located in a peripheral groove 205 formed in the edge of the piston.

The modulating piston member 194 cooperates with the cylinder 120 to form an expansible chamber 206 the size of which is varied by a hydraulic control system supplying lubricant under pressure into the chamber 206. At high lubricant pressures, the disc-shaped piston 194 and sleeve 180 will be shifted axially to the left as shown by dotted lines in FIG. 1. The chamber 206 may be unloaded when the piston 194 is moved to the right by removal of hydraulic fluid from chamber 206 by suitable means such as a bleed hole shown at 207 in modulating cylinder base wall 122.

The shaft 60 drive lug portion 202, which in the disclosed form is tapered or conical in vertical section, extends in a transverse or normal direction to the drive shaft axis. The lug 202 has formed therein a guide slot or cam track 212 which extends radially along the axis of the drive shaft. The journal element 154 carries an ear-like member 214 projecting normal to the journal forward face 216 and has a through bore for receiving cam follower means in the form of a cross pin driving member 220. As seen in the above-mentioned U.S. patent application Ser. No. 747,043, the ear 214 is offset from but parallel to a plane common to drive shaft principal axis and the sleeve slot 183. Upon the cross pin 220 contacting bottom radius 211 of the cam track 212 the journal element 154 is disposed in a plane perpendicular to the axis of rotation of the shaft 60 rendering the compressor ineffective to compress refrigerant gas. This results from the pin 220 being located at the radially inward limit of cam track 212 defining minimum or zero stroke length for each of the pistons 166. FIG. 1 shows the arrangement of the wobble plate mechanism 40 for maximum compressor capacity wherein the pin 220 is positioned at the radially outer end of cam track 212 defining the maximum stroke lengths for each of the pistons. It will be noted in FIG. 1 that the drive lug 202 is received in a complementary cone-shaped bore 215 in the drive shaft 60 and is suitably secured therein as by a cross pin 217 to properly align and lock the lug 202 against any movement in shaft bore 215.

As shown and described in the above-mentioned patent application Ser. No. 747,043, journal plate hub 224 has transverse bores 226 the axis of which intersects the rotational axis of shaft 60. Thus, the journal plate hub 224 receives the sleeve 180 in the hub's generally rectangular sectioned axial opening defined in part by upper and lower faces 227 and 228. The chamfered surface 229, which provides a clearance with sleeve surface 188 in the full stroke position, can be a cast-in-place surface for use as is. This design allows the four surfaces of the rectangular opening, including parallel side surfaces 231, to be formed by a single broaching operation. Upon assembly the journal cross bores 226 are aligned with sleeve bores (not shown) for the reception of the hollow transverse pivot or trunnion pins 230 permitting the wobble plate assembly 40 to pivot thereabout.

As described in the Black et al patent application Ser. No. 747,043, the opposite radiused ends 211 and 213 of the cam track 212 provide one method to define respectively, the maximum and minimum stroke lengths for each of the pistons 166. The result is the wobble plate mechanism 40 provides essentially constant top-dead-center (TDC) positions for each of the pistons. The pin cam follower 220 interconnects the wobble plate mechanism 40 and the drive shaft 60 and is movable radially with respect to the lug 202 and the wobble plate mechanism 40 in response to the movement of the sleeve 180. The angle of the wobble plate mechanism 40 is varied with respect to the drive shaft 60, between the solid and dashed line positions shown, to infinitely vary the stroke lengths of the pistons 166 and thus the output of the compressor.

Figure 2:
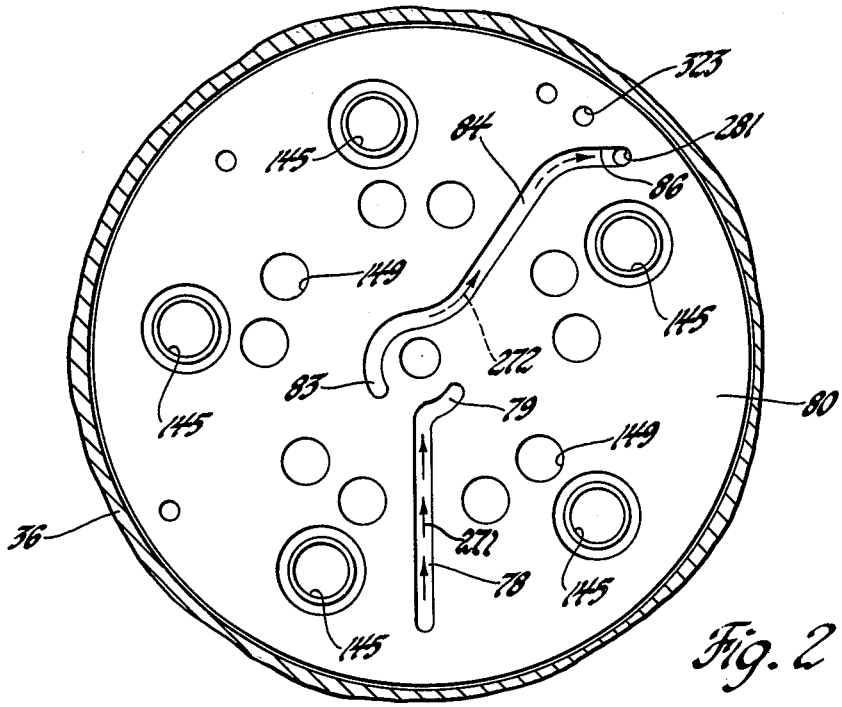
FIG. 2 is an enlarged fragmentary sectional view taken substantially on the line 2—2 of FIG. 1.

The lubricating and hydraulic control arrangement for applicant's compressor is indicated in part by short arrows 271 in FIGS. 1 and 2 showing oil being drawn up from the compressor sump area 71 through the pick-up tube 74 and through an aperture 250 in the suction inlet reed disc 77 and thence into the passage means in the form of the generally vertical slot or groove 78 formed in the inner face of the valve plate 80. The groove 78 upper arcuate portion 79 communicates with a kidney-shaped aperture 254 in the valve disc arranged directly over the intake area 81 of the gear pump 72. The oil gear pump assembly 72 pressurizes the oil as the pump is rotated on the end of the compressor shaft.

An internal flow path for the pump lubrication system is established by oil under pressure being discharged from the pump outlet through a slot in the reed disc 77 (not shown) into region 251 at the rear of the shaft portion 73 for flow through an axial bore 262 in shaft 60 for travel forwardly to a pair of transverse bores 264 in shaft 60 aligned with wobble plate pin bores (not shown) for flow between the journal hub 224 and the socket plate hub 268 to lubricate the journal bearing surfaces 156 and 158.

The modulation oil flow path, indicated by dashed arrows 272 in FIGS. 1 and 2, involves flow from the outlet of the pump 72 into the arcuate portion 83 and radial portion of the upper oil outlet groove 84 into the outer angled groove portion 86 and thence rearwardly through hole 281 in the valve plate 80 (FIG. 2) and thence via rear head bore 282 for entrance into the blind end region or cavity 284 of a hydraulic control valve generally indicated at 290 in FIG. 5. The valve 290 functions to control the amount of piston stroke by means of ball valve member 296, controlled by valve bellows 298, which senses evaporator pressure from the evaporator control unit 20 via line 302, liquid passage 304 in the rear head valve housing 306 and passage 308 in the valve casing 310.

As seen in FIG. 5, upon reaching the blind bore 284 the oil will flow through inlet 312 of valve stem 314 past the ball valve member 296 and thence into region 316 via axial stem bore 318 for exiting via exit bore 320. From exit bore 320 the oil returns to the compressor via rear head return bore 322 (FIG. 1) which communicates with valve plate hole 323 (FIG. 2) connected with the cylinder block rear bore portion 88 of the axial passage means. The bore 88 communicates with crossover tube 90, which in turn is connected to the front head downwardly sloped passage portion 94 and the radial passage portion 96 opening into axial bore 63.

Figure 4:
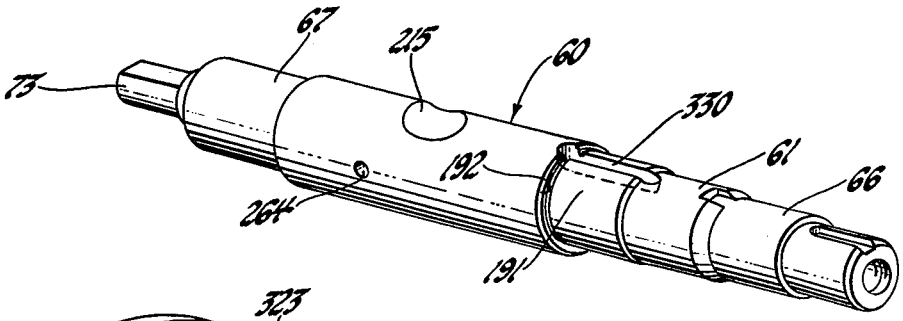
FIG. 4 is an enlarged perspective view of the compressor drive shaft.

With reference to FIGS. 1 and 4, it will be seen that the compressor main drive shaft 60 has an axially extending groove or elongated recess 330 extending rearwardly a predetermined distance beyond the cylinder bushing 112 so as to communicate with the modulating expansible chamber 206. The elongated recess 320 extends forwardly beyond the thrust bearing assembly 104 so as to communicate with the axial bore 63 and thereby the outlet of radial passage 96. Thus, the elongated shaft recess defines an axial open ended passage providing fluid flow communication between the inner end of the radial passage 96 and the expansible chamber 206.

Applicant's shaft recess 330 provides a hydraulic oil flow path to the modulation cylinder chamber 206 by virtue of the arrangement wherein the axial tubular extension 64 surrounds the shaft 60 allowing the front journal bearing 104 to be positioned forwardly of the radial duct 96. Further the front cover portion 67 of the front head 46 is located in a plane normal or transverse to the shaft 60, with the radial passage or duct 96 in the transverse plane of cover 67, such that the outlet of duct 96 is rearward and consequently clear of the front bearing 62. Thus a compressor housing of reduced overall axial dimension is achieved while the shaft recess 330 provides communication with the chamber 206 thereby eliminating the necessity of machining an axial bore in the front end of shaft 60 to establish the necessary oil flow path between the crossover passage means and the chamber 206. In addition by employing radial groove 84 in the valve plate 80, applicants have eliminated the necessity of machining an oil flow duct between adjacent cylinder bores 165 as this is an expensive operation in terms of time and scrappage.

It will be seen in FIG. 1 that a head pressure relief valve 340 communicates with the discharge chamber 144 while a suitable oil pressure relief valve (not shown) is provided in communication with passage 88 to limit the magnitude of the oil pressure.

Applicants have provided a spring loaded pump cover (FIG. 1) in the form of cover plate 342 biased against the inner surface of pump 72 by means of helical coil spring 344. It will be appreciated that in this arrangement axial dimensional tolerances of the pump are taken up by the spring 344, thereby eliminating tolerance build-up problems during assembly of the compressor. Bolts such as bolt 348 having one end secured to the shell 36 and the other end passing through a hole in lug 349 of the rear head assembly 140, are provided as shown in FIG. 1 for holding the housing elements in assembled relationship.

While the embodiment of the present invention as herein disclosed constitutes a preferred form, it is to be understood that other forms might be adopted. For example in FIG. 5 the evaporator control unit 20 could be replaced by an orifice tube expander between the evaporator 16 and condenser 28, together with a suction accumulator located between the compressor outlet 26 and the condenser 28 without departing from the scope of the invention. Also, the sleeve member 180, piston member 194 and counterbalance 196 could be cast as one integral member for ease of assembly and elimination of rivets.

We claim:

1. In A variable output compressor having a housing including a front end cover and a rear cylinder block, a crankcase in said housing, a drive shaft having its one end journaled in said rear cylinder block and its other end extending through an opening in said front end cover, said cylinder block having a plurality of cylinder bores formed therein substantially parallel to the axis of said shaft, pistons arranged to reciprocate in said cylinder bores, a wobble plate operated in response to rotation of said shaft and drivingly connected to said pistons, compressor output modulation means for varying the angle of inclination of said wobble plate relative to said drive shaft and thus the stroke of said pistons, said modulation means including an expansible hydraulic chamber actuator having an axially movable member for actuating said modulating means, an oil pump driven by said shaft, oil inlet passage means for conducting oil from said crankcase to the inlet of said pump, and oil outlet passage means for conducting oil from the outlet of said pump to said front end cover, the improvement comprising an axial protruding integral tubular extension on said front end cover outer surface surrounding said shaft other end, a front journal bearing on said shaft other end supported in said tubular extension, a radially extending passage in said front end cover having its outer end in communication with said oil outlet passage means, said expansible chamber actuator including a cup-shaped cylinder located in said housing adjacent said front end cover, said cylinder closed end having a forwardly extending tubular extension surrounding said shaft and fixedly secured thereto, whereby said cylinder is supported on said shaft in a concentric manner for rotation therewith, said axially movable member including a disc-shaped piston telescopically received in said cylinder rearwardly facing open end defining with said cylinder an expansible hydraulic chamber, an axially extending recess in the shaft portion surrounded by said cylinder tubular extension, said recess extending a predetermined distance beyond the forward and rearward ends of said cylinder tubular extension so as to define an axial open ended passage therewith providing fluid flow communication between the inner end of said radial passage and said expansible chamber; whereby said pump oil outlet passage means, including means for controlling flow of oil from said pump, is in communication with said expansible chamber for effecting movement of said disc-shaped piston and the resultant angle of inclination of said wobble plate.

2. In a variable output compressor having a housing including cylindrical casing element, a front end cover and a rear cylinder head disposed intermediate the ends of said cylindrical casing element, a crankcase in said housing, a rear cylinder block disposed in said casing adjacent said rear head, a valve plate and a reed valve disc in series flush contact between said rear head and said cylinder block, a drive shaft having its one end journaled in said rear cylinder block and its other end extending through an opening in said front end cover, said cylinder block having a plurality of cylinder bores formed therein substantially parallel to the axis of said shaft, pistons arranged to reciprocate in said cylinder bores, a valve plate and intake reed valve disc in series flush contact intermediate said rear head and said rear cylinder block, said plate and disc having aligned inlet and outlet ports therein, a wobble plate operated in response to rotation of said shaft and drivingly connected to said pistons, compressor output modulation means for varying the angle of inclination of said wobble plate relative to said drive shaft and thus the stroke of said pistons, said modulation means including an expansible hydraulic chamber actuator having an axially movable member for actuating said modulating means, an oil pump driven by said shaft, oil inlet passage means for conducting oil from said crankcase to the inlet of said pump, a radial groove formed in the inner face of said valve plate providing communication between the outlet of said pump and the rearward inlet of an axially extending duct in said cylinder block, the forward outlet end of said cylinder duct connected to an axially extending crossover tube positioned outboard of said swash plate mechanism, said crossover tube forward end communicating with duct means in said front head, an axial protruding integral tubular extension on said front end cover outer surface surrounding said shaft other end, a front journal bearing on said shaft other end supported substantially in said tubular extension, said front head duct means including a radially extending duct in said front end cover having its outer portion in communication with the outlet of said crossover tube, said expansible chamber actuator including a cup-shaped cylinder located in said housing adjacent said front end cover, said cylinder closed end having a forwardly extending tubular extension surrounding said shaft and fixedly secured thereto, whereby said cylinder is supported on said shaft in a concentric manner for rotation therewith, said axially movable member including a disc-shaped piston telescopically received in said cylinder rearwardly facing open end defining with said cylinder an expansible hydraulic chamber, an axially extending recess in the shaft portion surrounded by said cylinder tubular extension, said recess extending a predetermined distance beyond the forward and rearward ends of said cylinder tubular extension so as to define an axial open ended passage therewith providing fluid flow communication between the inner end of said radial passage and said expansible chamber; whereby said pump oil outlet passage means, including means for controlling flow of oil from said pump, is in communication with said expansible chamber for effecting movement of said disc-shaped piston and the resultant angle of inclination of said wobble plate.

* * * * *